US009400112B2

(12) United States Patent
Bellino et al.

(10) Patent No.: US 9,400,112 B2
(45) Date of Patent: Jul. 26, 2016

(54) METHOD FOR DISASSEMBLING A BUNDLED TUBE FUEL INJECTOR

(71) Applicant: General Electric Company, Schenectady, NY (US)

(72) Inventors: Mark Carmine Bellino, Greenville, SC (US); James Christopher Monaghan, Moore, SC (US); Johnie F. McConnaughhay, Greenville, SC (US); Steven Charles Woods, Easley, SC (US); Gregory Scott Means, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 350 days.

(21) Appl. No.: 14/105,317

(22) Filed: Dec. 13, 2013

(65) Prior Publication Data

US 2015/0167556 A1 Jun. 18, 2015

(51) Int. Cl.
*F02C 7/232* (2006.01)
*F23R 3/28* (2006.01)

(52) U.S. Cl.
CPC ..... *F23R 3/283* (2013.01); *F23R 3/286* (2013.01); *F23R 2900/00017* (2013.01); *F23R 2900/00019* (2013.01); *Y10T 29/49815* (2015.01); *Y10T 29/49821* (2015.01)

(58) Field of Classification Search
CPC ..... F23R 3/283; F23R 3/286; F23R 2900/00017; F23R 2900/00019; Y10T 29/49821; Y10T 29/49815
See application file for complete search history.

(56) References Cited

U.S. PATENT DOCUMENTS

| | | | | |
|---|---|---|---|---|
| 4,607,423 | A * | 8/1986 | Sleep, Jr. | F28F 9/0219 228/183 |
| 5,094,801 | A | 3/1992 | Dixon et al. | |
| 5,205,038 | A | 4/1993 | Archer et al. | |
| 5,271,048 | A | 12/1993 | Behnke et al. | |
| 5,274,991 | A * | 1/1994 | Fitts | F23R 3/283 60/39.37 |
| 5,367,768 | A | 11/1994 | Weems | |
| 5,404,382 | A | 4/1995 | Russ et al. | |
| 5,605,361 | A | 2/1997 | Sims | |
| 6,345,084 | B1 | 2/2002 | Jensen | |
| 7,551,705 | B2 | 6/2009 | Pabis et al. | |
| 9,259,807 | B2 * | 2/2016 | Means | B23P 6/002 |

* cited by examiner

*Primary Examiner* — Ryan J Walters
(74) *Attorney, Agent, or Firm* — Dority & Manning, PA

(57) ABSTRACT

A method for disassembling a bundled tube fuel injector includes decoupling an aft plate from a fuel distribution module of the bundled tube fuel injector, where the aft plate is disposed at a downstream end of the bundled tube fuel injector. The method also includes removing the aft plate from the bundled tube fuel injector to expose a portion of a plurality of pre-mix tubes so as to allow for inspection repair and/or replacement of one or more of the plurality of pre-mix tubes.

16 Claims, 6 Drawing Sheets

METHOD FOR DISASSEMBLING A BUNDLED TUBE FUEL INJECTOR

FIELD OF THE INVENTION

The present invention generally involves a bundled tube fuel injector such as may be incorporated into a combustor of a gas turbine or other turbomachine. Specifically, the invention relates to a method for disassembling the bundled tube fuel injector.

BACKGROUND OF THE INVENTION

Gas turbines are widely used in industrial and power generation operations. A typical gas turbine may include a compressor section, a combustion section disposed downstream from the compressor section, and a turbine section disposed downstream from the combustion section. A working fluid such as ambient air flows into the compressor section where it is progressively compressed before flowing into the combustion section. The compressed working fluid is mixed with a fuel and burned within one or more combustors of the combustion section to generate combustion gases having a high temperature, pressure, and velocity. The combustion gases flow from the combustors and expand through the turbine section to produce thrust and/or to rotate a shaft, thus producing work.

The combustors may be annularly arranged between the compressor section and the turbine section. In a particular combustor design, the combustors include one or more axially extending bundled tube fuel injectors that extend downstream from an end cover. The end cover generally includes one or more fuel circuits that provide fuel to a fluid conduit that provides for fluid communication between the fuel circuits and a fuel plenum defined within each bundled tube fuel injector.

The bundled tube fuel injector generally includes a plurality of pre-mix tubes arranged radially and circumferentially across the bundled tube fuel injector. The pre-mix tubes extend generally parallel to one another through the bundled tube fuel injector. An outer shroud extends circumferentially around the pre-mix tubes, and an aft plate extends radially and circumferentially across a downstream end of the outer shroud adjacent to a combustion chamber or zone defined within the combustor. A cooling air plenum is defined within the outer shroud between the fuel plenum and the aft plate. A tube tip portion of each pre-mix tube extends through the aft plate such that an outlet of each tube is downstream from a hot side surface of the aft plate, thus providing for fluid communication into the combustion chamber or zone.

Each of the pre-mix tubes extends generally axially through the fuel plenum and the cooling air plenum. The compressed working fluid is routed through inlets of each of the parallel pre-mix tubes upstream from the fuel plenum. Fuel is supplied to the fuel plenum through the fluid conduit and the fuel is injected into the pre-mix tubes through one or more fuel ports defined within each of the pre-mix tubes. The fuel and compressed working fluid mix inside the pre-mix tubes before flowing out of the outlet of each of the pre-mix tubes and into the combustion chamber or zone for combustion.

Over time various factors including thermal stress, mechanical fatigue and combustion dynamics or vibrations may adversely affect the operating condition of the bundled tube fuel injectors, thus requiring scheduled inspection and in some cases repair or refurbishment of the bundled tube fuel injectors. Conventional disassembly methods for tearing down non-bundled tube fuel injectors are generally ineffective for disassembling bundled tube fuel injectors for repair and/or refurbishment. Therefore, a method for disassembling a bundled tube fuel injector for repair and/or refurbishment would be useful.

BRIEF DESCRIPTION OF THE INVENTION

Aspects and advantages of the invention are set forth below in the following description, or may be obvious from the description, or may be learned through practice of the invention.

One exemplary embodiment of the present invention is a method for disassembling a bundled tube fuel injector. The method includes decoupling an aft plate from a fuel distribution module of the bundled tube fuel injector, where the aft plate is disposed at a downstream end of the bundled tube fuel injector. The method also includes removing the aft plate from the bundled tube fuel injector to expose a portion of a plurality of pre-mix tubes so as to allow for inspection repair and/or replacement of one or more of the plurality of pre-mix tubes Another exemplary embodiment of the present disclosure is a method for disassembling a bundled tube fuel injector. The method includes removing one or more fasteners that extend between an outer shroud and a fuel distribution module of the bundled tube fuel injector where the outer shroud circumferentially surrounds a plurality of pre-mix tubes. The method further includes decoupling a forward portion of the outer shroud from the fuel distribution module, and removing the outer shroud to expose a portion of the plurality of pre-mix tubes.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
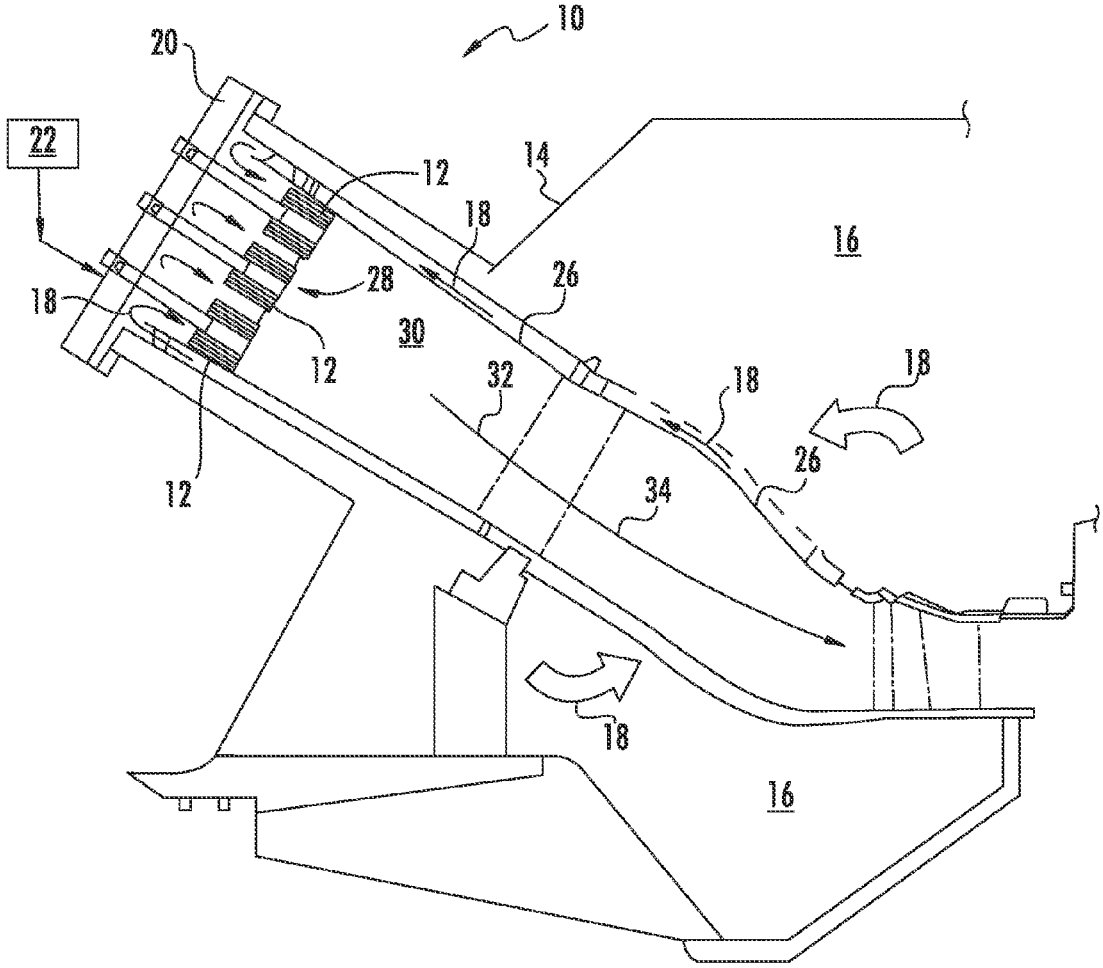
FIG. 1 is a simplified cross-section side view of an exemplary combustor according to various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a bundled tube fuel injector incorporated into a combustor of a gas turbine for purposes of illustration, one of ordinary skill in the art will readily appreciate that embodiments of the present invention may be applied to any combustor incorporated into any turbomachine and are not limited to a gas turbine combustor unless specifically recited in the claims.

Referring now to the drawings, wherein identical numerals indicate the same elements throughout the figures, FIG. 1 provides a simplified cross section of an exemplary combustor 10 as may incorporate a bundled tube fuel injector 12, herein referred to as "fuel injector", configured according to at least one embodiment of the present disclosure. As shown, the combustor 10 is at least partially surrounded by an outer casing 14. The outer casing at least partially forms a high pressure plenum 16 around the combustor 10. The high pressure plenum 16 may be in fluid communication with a compressor or other source for supplying a compressed working fluid 18 such as air to the combustor 10. For example, the high pressure plenum 16 may in fluid communication with an axial compressor of a gas turbine. In one configuration, an end cover 20 is coupled to the outer casing 14. The end cover 20 may be in fluid communication with a fuel supply 22.

The fuel injector 12 may be coupled to the end cover 20 via one or more mechanical fasteners such as bolts, screws or the like. The fuel injector 12 extends downstream from the end cover 20 within the outer casing 14. The fuel injector 12 may be fluidly connected to the end cover 20 so as to receive fuel from the fuel supply 22. In the alternative, the fuel injector 12 may receive fuel directly from the fuel supply 22. In one embodiment, a fluid conduit 24 provides for fluid communication between the end cover 20 and/or the fuel supply 22 and the fuel injector 12.

One end of an annular liner 26 such as a combustion liner and/or a transition duct surrounds a downstream end 28 of the bundled tube fuel injector 12 so as to at least partially define a combustion chamber 30 within the combustor 10. The liner 26 at least partially defines a hot gas path 32 for directing combustion gases 34 from the combustion chamber 30 through the combustor 10. For example, the hot gas path 32 may be configured to route the combustion gases 34 towards an exhaust duct to produce thrust and/or a turbine to cause a rotor shaft to rotate, thus providing mechanical work.

Figure 2:
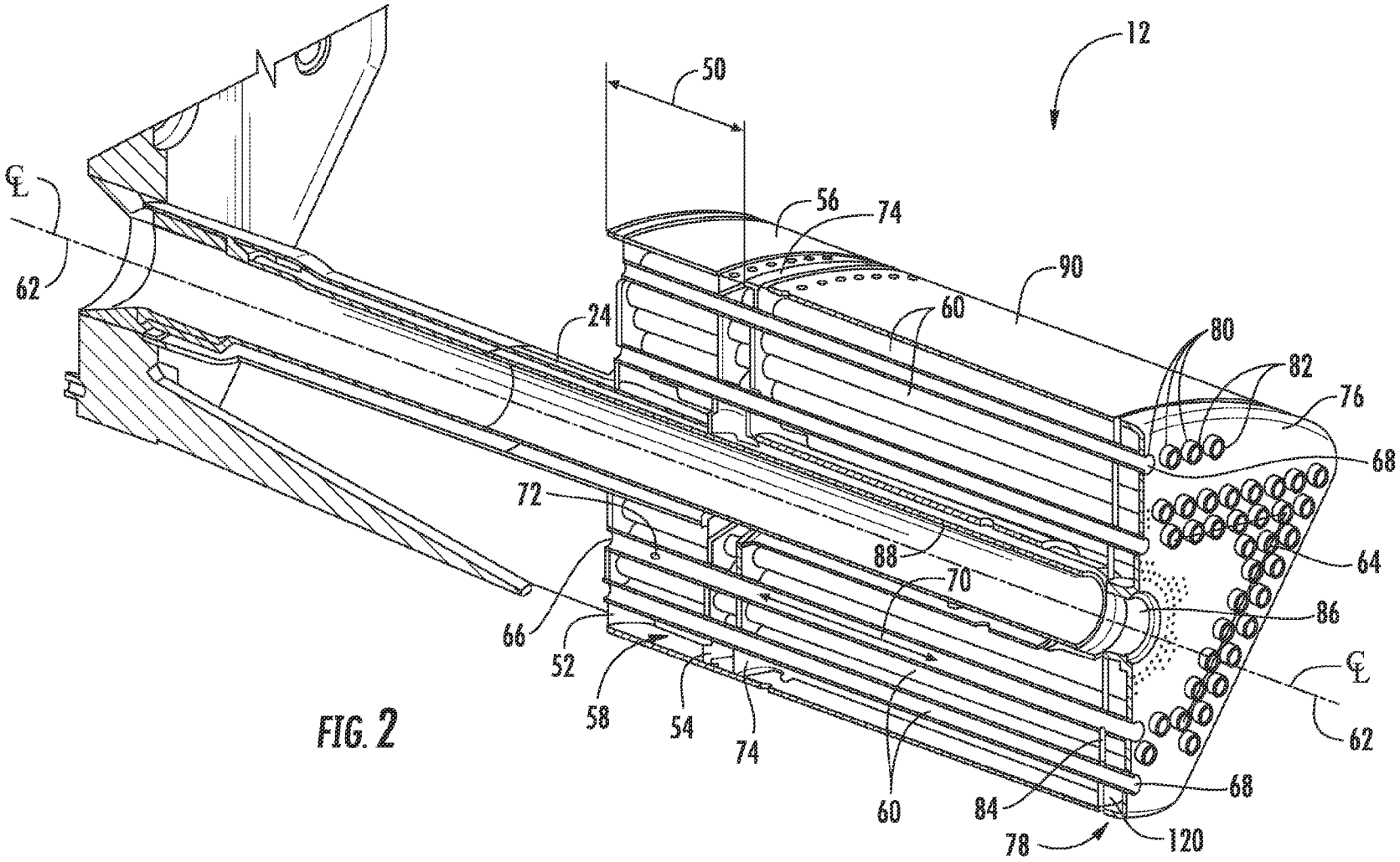
FIG. 2, is a cross sectional perspective view of an exemplary bundled tube fuel injector according to various embodiments of the present disclosure.

FIG. 2 is a cross section perspective view of an exemplary bundled tube fuel injector 12 connected to a portion of the end cover 20, according to various embodiments of the present disclosure. As shown, the fuel injector 12 generally includes a fuel distribution module 50 that is in fluid communication with the fluid conduit 24. In particular embodiments, the fuel distribution module 50 includes an upstream plate 52 that is axially separated from a downstream plate 54. An outer band 56 circumferentially surrounds and extends axially between the upstream and downstream plates 52, 54. The outer band 56 may extend axially beyond either one or both of the upstream and downstream plates 52, 54. A fuel plenum 58 is at least partially defined between the upstream and downstream plates 52, 54 and the outer band 56. The fluid conduit 24 provides for fluid communication between the fuel supply 22 (FIG. 1) and the fuel plenum 58.

As shown in FIG. 2, the fuel injector 12 further includes a tube bundle comprising a plurality of pre-mix tubes 60 that extend generally parallel to one another along or parallel to an axial centerline 62 of the fuel injector 12. In one embodiment, the pre-mix tubes 60 are arranged in multiple rows 64. Each row 64 may include one or more of the pre-mix tubes 60. In one embodiment, each row 64 is radially spaced with respect to the axial centerline 62 from an adjacent row 64. The pre-mix tubes 60 of each row 64 may be arranged generally annularly or circumferentially across the fuel injector 12 with respect to an axial centerline of the combustor 10 and/or the axial centerline 62 of the fuel injector 12. In one embodiment, the pre-mix tubes 60 extend through the upstream plate 52, the fuel plenum 58 and the downstream plate 54.

An exemplary pre-mix tube 60 includes an inlet 66 defined upstream from the fuel plenum 60, an outlet 68 defined downstream from the fuel plenum 58 and a pre-mix passage 70 defined within the pre-mix tube 60 between the inlet 66 and the outlet 68. The pre-mix tubes 60 may comprise multiple pre-mix tube sections coaxially aligned and joined together to define the pre-mix passage 70 or may be formed as single continuous tubes. In particular embodiments, at least some of the pre-mix tubes 60 include one or more fuel ports 72 that provide for fluid communication between the fuel plenum 58 and the corresponding pre-mix passages 70. The pre-mix tubes 60 extend generally axially downstream from the fuel supply module 56 towards the combustion chamber 30 (FIG. 1).

Although generally illustrated as cylindrical, the pre-mix tubes 60 may be any geometric shape, and the present invention is not limited to any particular cross-section unless specifically recited in the claims. The pre-mix tubes 60 may be grouped or arranged in circular, triangular, square, or other geometric shapes, and may be arranged in various numbers and geometries.

In particular configurations, an alignment or support plate 74 is coupled to the fuel distribution module 50. The support plate 74 may be coupled to the fuel distribution module 50 via welding, brazing, mechanical fasteners or by any suitable means for the operating environment of the fuel injector 12. The support plate 74 extends generally radially outwardly and circumferentially with respect to the axial centerline 62 and may be disposed generally parallel to the downstream plate 54. An aft plate 76 is disposed at a downstream or aft end 78 an of the fuel injector 12. The aft plate 76 extends radially outwardly and circumferentially, with respect to the axial centerline 62, across the aft end 78 of the fuel injector 12. The aft plate 76 at least partially defines a plurality of tube tip passages 80 that extend generally axially through the aft plate 76. Each tube tip passage 80 is generally aligned with a corresponding pre-mix tube 60. The tube tip passages 80 are generally sized to allow a tube tip portion 82 of the pre-mix tubes 60 to extend therethrough.

In particular embodiments, an impingement plate 84 is disposed upstream from the aft plate 76. The impingement plate 84 may be welded, brazed or otherwise coupled to the aft plate 76. The aft plate 76 and/or the impingement plate 84 may at least partially define a center fuel nozzle passage 86 that extends generally axially therethrough. A center or diffusion fuel nozzle 88 may be coupled to the aft plate 76 at the center nozzle passage 86. As shown in FIG. 2, the pre-mix tubes 60 extend axially through the support plate 74, the impingement plate 82 and the aft plate 76 such that the tube tip portion 82 of each of the pre-mix tubes 60 extends axially beyond the aft plate 76.

As shown in FIG. 2, an outer shroud 90 circumferentially surrounds a portion of the pre-mix tubes 60 that extends downstream from the fuel distribution module 50. In one embodiment, the outer shroud 90 extends axially between the support plate 74 and the aft plate 76. In an alternate embodiment, such as when the fuel injector 12 does not include an alignment plate 74, the outer shroud 90 extends directly between the aft plate 76 and the fuel distribution module 50. The outer shroud 90 may be coupled to the support plate 74, the fuel distribution module 50 and/or the aft plate 76 via welding, brazing, mechanical fasteners or by any suitable means for the operating environment of the fuel injector 12.

Figure 3:
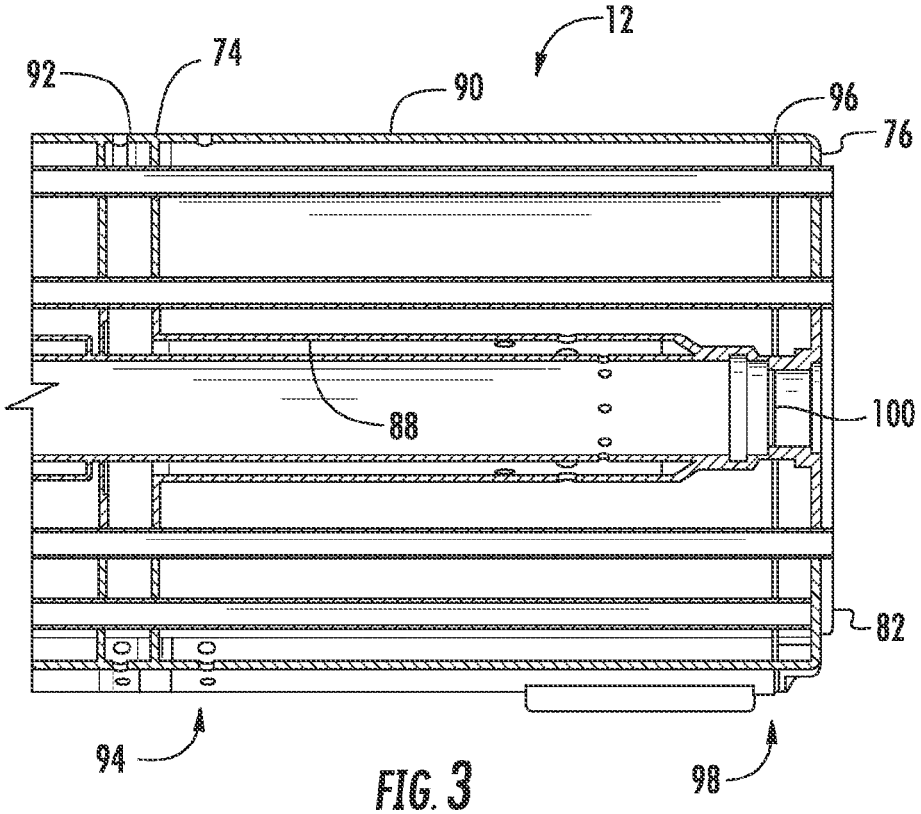
FIG. 3, is a cross sectional side view of a portion of the bundled tube fuel injector as shown in FIG. 2, according to one embodiment of the present invention; d
Figure 4:
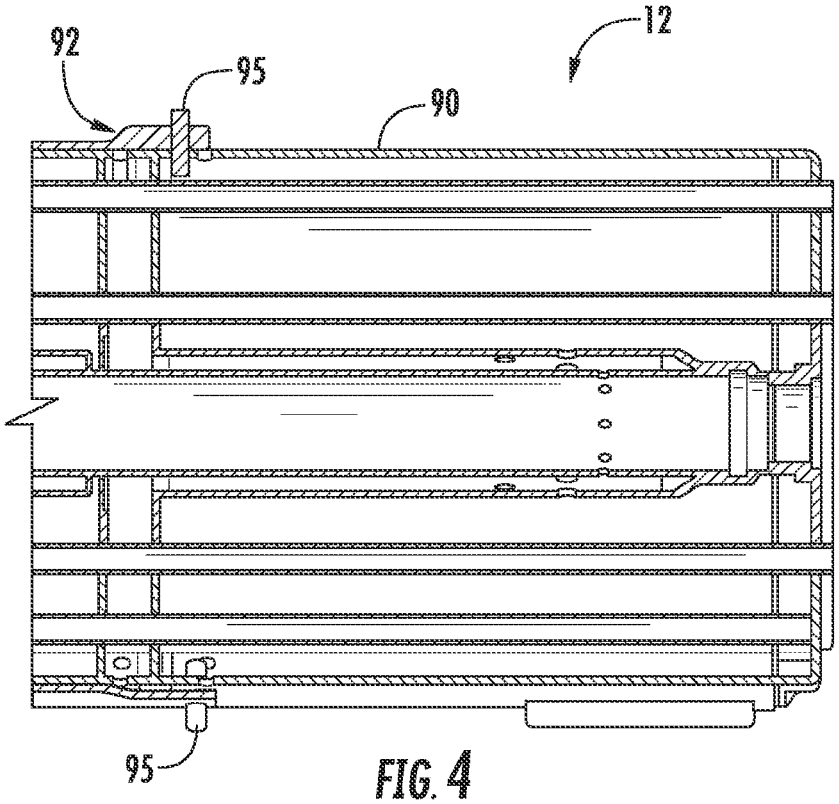
FIG. 4, is a cross sectional side view of a portion of the bundled tube fuel injector as shown in FIG. 2, according to one embodiment of the present invention.

Various connection joints are formed between the various components when the fuel injector 12 is assembled. FIG. 3 is an enlarged cross section side view of a portion of the fuel injector 12 as shown in FIG. 2. In one configuration, as shown in FIG. 3, the outer shroud 90 and the fuel distribution module 50 are coupled at a first connection joint 92. The first connection joint 92 may be defined between the fuel distribution module 50 and the support plate 74 as shown. In an alternate embodiment, the first connection joint 92 may be defined between a forward or upstream portion 94 of the outer shroud 90 and the fuel distribution plenum 50. The first connection joint 92 may be a weld joint, brazed joint or a pinned joint. For example, in one embodiment, as shown in FIG. 4, the first connection joint 92 may be a pinned joint including one or more fasteners 95 such as pins, bolts, rivets or screws.

As shown in FIG. 3, a second connection joint 96 is defined between the aft plate 76 and an aft or downstream portion 98 of the outer shroud 90. The second connection joint 96 may be a weld joint, brazed joint or a pinned joint. In one embodiment, a third connection joint 100 is defined between the center fuel nozzle 88 and the aft plate 76. The third connection joint 100 may be a weld joint, brazed joint or a mechanically fastened joint.

Figure 5:
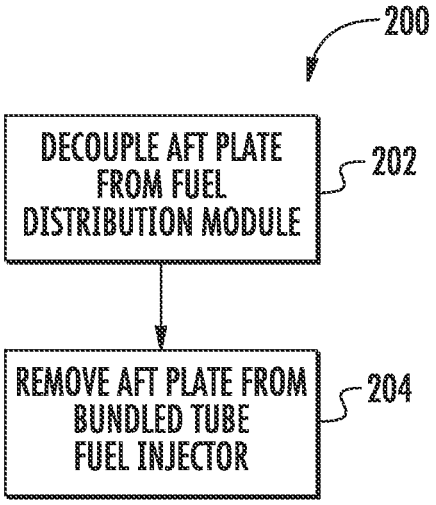
FIG. 5 is flow chart depicting an exemplary method for disassembling the bundled tube fuel injector as shown in FIG. 2, according to one embodiment of the present disclosure.

In order to inspect, repair and/or refurbish the fuel injector 12, the fuel injector 12 should be disassembled in a manner which exposes a portion of the pre-mix tubes and reduces rework and/or secondary operations, thus reducing costs and time to repair. FIG. 5 is a flow chart diagram for an exemplary method 200 for disassembling the bundled tube fuel injector 12, according to at least one embodiment of the present invention. FIGS. 6, 7, 8 and 9 provide illustrations of the various steps according to the exemplary method 200 presented in FIG. 5.

Figure 6:
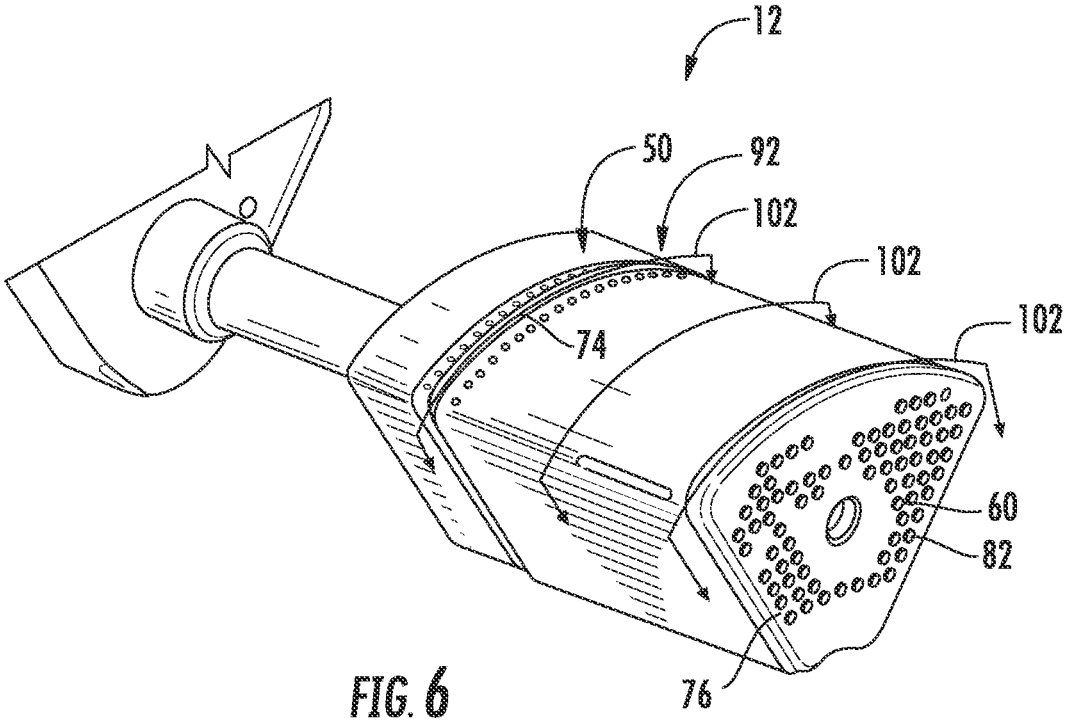
FIG. 6 is a perspective view of the bundled tube fuel injector in an assembled state as shown in FIG. 2.
Figure 7:
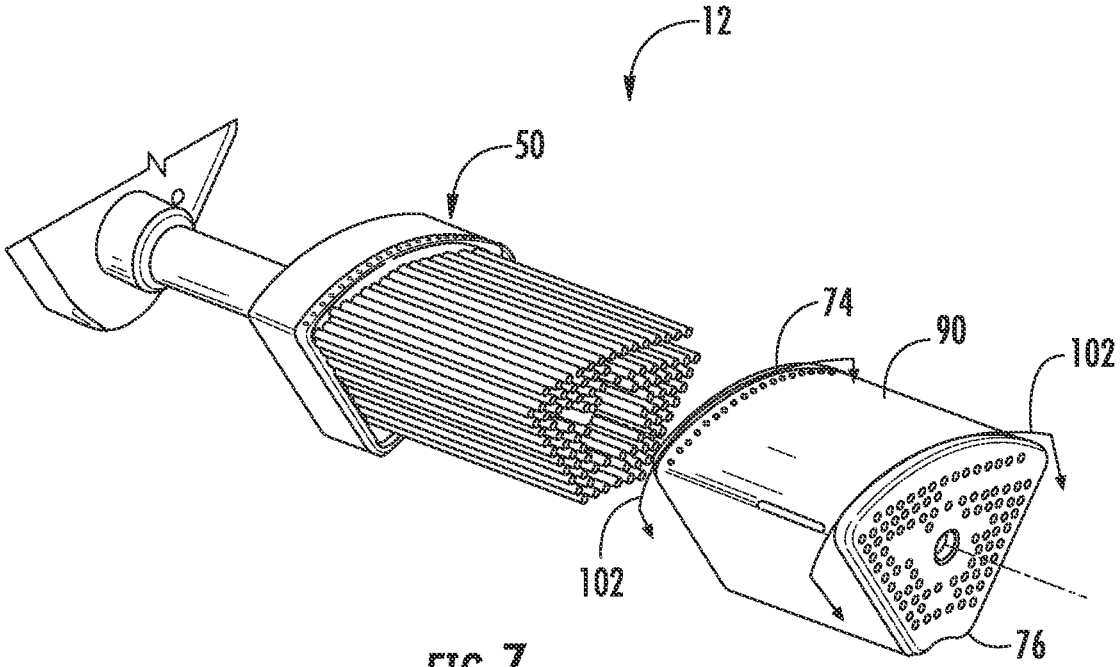
FIG. 7 is a perspective view of the bundled tube fuel injector with an aft plate decoupled from the bundled tube fuel injector.

In one embodiment, at step 202 as illustrated in FIG. 6, the method 200 includes decoupling the aft plate 76 from the fuel distribution module 50, and at step 204 as illustrated in FIG. 7, the method 200 further includes removing the aft plate 76 from the bundled tube fuel injector 12 to expose a portion of a plurality of pre-mix tubes 60. As shown in FIG. 7, step 204 may include sliding the aft plate 76 and at least a portion of the outer shroud 90 and/or the alignment plate 74 generally axially away from the fuel distribution module 50 so as to expose the plurality of pre-mix tubes 60.

In one embodiment, as illustrated in FIG. 6, the aft plate 76 may be decoupled from the fuel distribution manifold 50 by cutting or machining circumferentially around and through the outer shroud 90. For example, a cut 102 may be made at the first connection joint 92 or anywhere along the outer shroud 90 between the fuel distribution module 50 and the aft plate 76. In another embodiment, the aft plate 76 may be decoupled from the fuel distribution manifold 50 by severing the first connection joint 92 where the first connection joint 92 is defined between the alignment plate 74 and the fuel distribution module 50. The cut 102 may be made using any cutting or machining process, conventional or non-conventional, that is suitable for cutting through a metal component such as laser cutting or electrical discharge machining. In another embodiment, the aft plate 76 may be cut away from the aft or downstream portion 98 of the outer shroud 90 with the outer shroud 90 remaining in situ, thus allowing for inspection, repair and/or replacement of the pre-mix tubes 60.

In another embodiment, where the outer shroud 90 is coupled to the fuel distribution module 50 via one or more fasteners 95, as illustrated in FIG. 4, the aft plate 76 may be decoupled from the fuel distribution manifold 50 by removing or extracting the fasteners 95. For example, the fasteners 95 may be cut, drilled or otherwise extracted.

In one embodiment, where at least one of the tube tips 86 is deformed across and/or burned to the aft plate 76, thus preventing the aft plate from being removed from the fuel injector 12, the step of decoupling the aft plate 76 may include removing the deformed tube tip 86. For example, the deformed tube tip 86 may be drilled out or cut away from the aft plate 76. In one embodiment, where the bundled tube fuel injector includes the impingement plate 82 disposed upstream from the aft plate 76, the step of decoupling the aft plate 76 from the fuel distribution module 50 may further include removing the aft plate 76 and the impingement plate 82 simultaneously.

Figure 8:
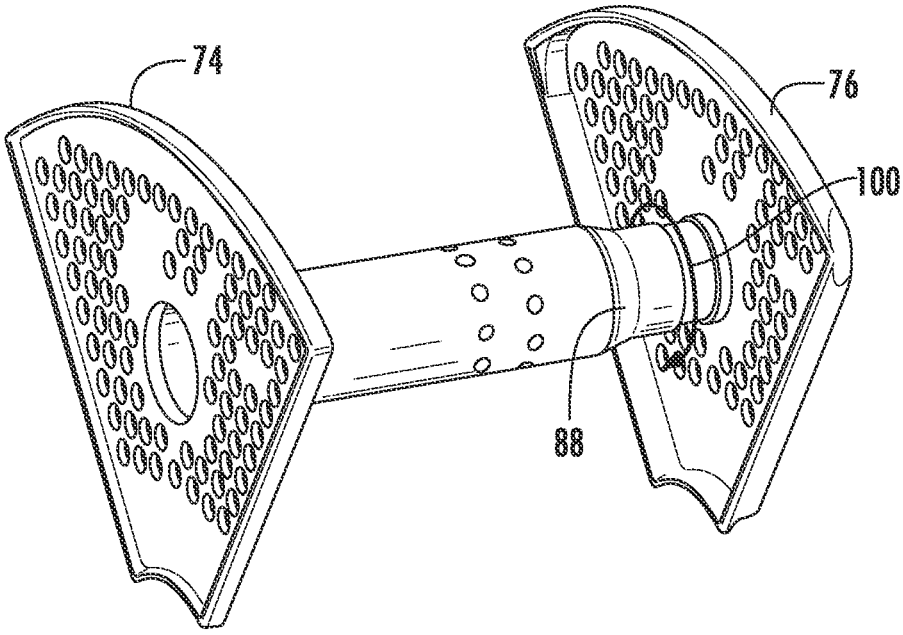
FIG. 8 is a perspective view of the aft plate as shown in FIG. 7 coupled to a center fuel nozzle and an alignment plate according to one embodiment of the present disclosure.
Figure 9:
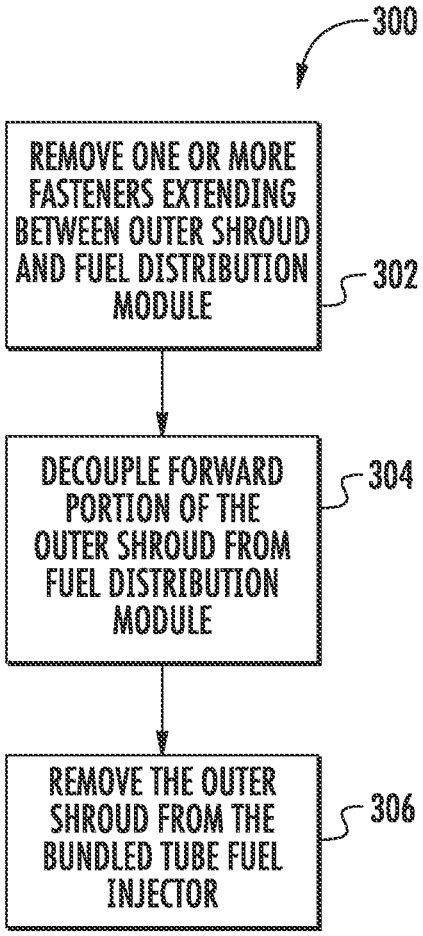
FIG. 9 is flow chart depicting an exemplary method for disassembling the bundled tube fuel injector as shown in FIG. 2, according to one embodiment of the present disclosure.

In another embodiment, as illustrated in FIGS. 8 and 9, the method 200 may further include decoupling the outer shroud 90 from the aft plate 76 and/or the alignment plate 74, thus exposing the center fuel nozzle 88 for inspection, repair and/or replacement. The outer shroud 90 may be decoupled from the alignment plate 74 and/or the aft plate 76 via any conventional or non-conventional cutting process. For example, the outer shroud may be decoupled via laser cutting, electrical discharge machining. In another embodiment, as shown in FIG. 9, the method 200 may further include decoupling the center fuel nozzle 88 from the aft plate 76. For example, the center fuel nozzle 88 may be decoupled from the aft plate 76 via any conventional or non-conventional cutting process or may be decoupled by removing a fastener such as a retaining ring or the like (not shown).

FIG. 10 is a flow chart of another exemplary method 300 for disassembling the bundled tube fuel injector 12. As shown in FIG. 6, at step 302, the method 300 includes removing the one or more fasteners 95 (FIG. 4) that extend between the outer shroud 90 and the fuel distribution module 50. The fasteners may be removed by cutting, machining, drilling, extraction or by any convention or nonconventional method suitable for removing the fasteners. The fasteners may include rivets, pins, bolts, screws or the like.

At step 304, the method 300 further includes decoupling the forward portion 94 of the outer shroud 90 from the fuel distribution module 50. The outer shroud 90 may be decoupled by prying or pulling the outer shroud 90 away from the fuel distribution module 50. At step 306, the method includes removing the outer shroud 90 to expose a portion of the plurality of pre-mix tubes 60, thus allowing for inspection, repair or replacement of the pre-mix tubes 60.

The method 300 may further include removing the tip portion 82 of at least one of the plurality of pre-mix tubes 60. The tip portion may be removed by at least one of cutting or drilling the tip portion so as to allow for removal or separation of the aft plate from the fuel injector 12 and/or the outer shroud 90. In another embodiment, the method 300 may further include removing the aft plate and the impingement plate simultaneously.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method for disassembling a bundled tube fuel injector, comprising:

decoupling an aft plate from a fuel distribution module of a bundled tube fuel injector, wherein the aft plate is disposed at a downstream end of the bundled tube fuel injector, wherein the fuel distribution module comprises an upstream plate, a downstream plate axially spaced from the upstream plate and an outer band that extends axially between and circumferentially surrounds the upstream plate and the downstream plate, wherein the upstream plate, the downstream plate and the outer band define a fuel plenum therebetween; and removing the aft plate from the bundled tube fuel injector to expose a portion of a plurality of pre-mix tubes, wherein a portion of each tube extends through the fuel plenum of the fuel distribution manifold.

2. The method as in claim 1, wherein the aft plate is coupled to the fuel distribution module via an outer shroud, the step of decoupling the aft plate from the fuel distribution module further comprising circumferentially cutting the outer shroud.

3. The method as in claim 1, wherein the aft plate is coupled to the fuel distribution module via an outer shroud and the outer shroud is coupled to the fuel distribution module via one or more fasteners, the step of decoupling the aft plate from the fuel distribution module further comprising removing the fasteners.

4. The method as in claim 1, wherein the aft plate is coupled to the fuel distribution module via an outer shroud and an alignment plate, wherein the alignment plate defines a connection joint with the fuel distribution module, the step of decoupling the aft plate from the fuel distribution module comprising severing the connection joint.

5. The method as in claim 1, wherein the aft plate is coupled to the fuel distribution module via an outer shroud and the outer shroud is coupled to the fuel distribution module, the aft plate being coupled to an aft portion of the outer shroud, the step of decoupling the aft plate from the fuel distribution module comprising cutting the aft plate from the downstream portion of the outer shroud.

6. The method as in claim 1, further comprising decoupling a center fuel nozzle from the aft plate.

7. The method as in claim 1, wherein the aft plate is coupled to the fuel distribution module via an outer shroud and an alignment plate disposed at a forward portion of the outer shroud, further comprising decoupling the outer shroud from the aft plate and the alignment plate.

8. The method as in claim 1, wherein a tip portion of at least one of the plurality of pre-mix tubes is deformed across the aft plate, the step of decoupling the aft plate from the fuel distribution module further comprising drilling out or cutting away the deformed tip portion.

9. The method as in claim 1, wherein the bundled tube fuel injector includes an impingement plate disposed upstream from the aft plate and connected to the outer shroud, the step of decoupling the aft plate from the fuel distribution module comprising removing the aft plate and the impingement plate simultaneously.

10. The method as in claim 1, wherein the step of decoupling the aft plate from the fuel distribution module comprises at least one of laser cutting and electrical discharge machining.

11. A method for disassembling a bundled tube fuel injector, comprising:

removing one or more fasteners that extend between an outer shroud and an outer band of a fuel distribution module of the bundled tube fuel injector, wherein the outer shroud circumferentially surrounds a plurality of pre-mix tubes, wherein the fuel distribution module comprises an upstream plate, a downstream plate axially spaced from the upstream plate, wherein the outer band extends axially between and circumferentially surrounds the upstream plate and the downstream plate, wherein the upstream plate, the downstream plate and the outer band define a fuel plenum therebetween, wherein the plurality of pre-mix tubes extends axially through the fuel plenum;

decoupling a forward portion of the outer shroud from the fuel distribution module; and removing the outer shroud to expose a portion of the plurality of pre-mix tubes.

12. The method as in claim 11, wherein the step of removing one or more fasteners comprises cutting or drilling the fasteners.

13. The method as in claim 11, wherein the step of removing one or more fasteners comprises at least one of cutting or extracting a plurality of rivets or pins.

14. The method as in claim 11, wherein the bundled tube fuel injector includes an aft plate disposed at an aft end of the outer shroud, wherein a tip portion of the plurality of pre-mix tubes extends axially through the aft plate, the step of removing the outer shroud further comprising removing the tip portion of at least one of the plurality of pre-mix tubes.

15. The method as in claim 14, wherein removing the tip portion of at least one of the plurality of tubes comprises at least one of cutting or drilling the tip portion.

16. The method as in claim 14, wherein the bundled tube fuel injector includes an impingement plate disposed upstream from the aft plate and connected to the outer shroud, the step of removing the outer shroud further comprising removing the aft plate and the impingement plate simultaneously.

* * * * *